US006151804A

United States Patent [19]

Hieblinger

[11] Patent Number: 6,151,804

[45] Date of Patent: Nov. 28, 2000

[54] ATHLETIC SHOE, ESPECIALLY SOCCER SHOE

[75] Inventor: Rudolf Hieblinger, Munich, Germany

[73] Assignee: Puma AG Rudolf Dassler Sport, Herzogenaurach, Germany

[21] Appl. No.: 09/101,442

[22] PCT Filed: Jan. 13, 1997

[86] PCT No.: PCT/EP97/00122

§ 371 Date: Jul. 15, 1998

§ 102(e) Date: Jul. 15, 1998

[87] PCT Pub. No.: WO97/25889

PCT Pub. Date: Jul. 24, 1997

[30] Foreign Application Priority Data

Jan. 15, 1996 [DE] Germany ..... 196 01 219

[51] Int. Cl.[7] ..... A43B 23/00

[52] U.S. Cl. ..... 36/128; 36/88; 36/45

[58] Field of Search ..... 36/128, 88, 91, 36/45

[56] References Cited

U.S. PATENT DOCUMENTS

| | | | |
|---|---|---|---|
| 210,529 | 12/1878 | Hauber . | |
| 1,258,629 | 2/1918 | Bliss . | |
| 1,283,335 | 10/1918 | Shillcock . | |
| 2,034,091 | 3/1936 | Dunbar | 36/45 |
| 4,413,431 | 11/1983 | Cavanagh | 36/45 |
| 4,447,967 | 5/1984 | Zaino | 36/45 |
| 4,756,098 | 7/1988 | Boggia | 36/114 |
| 5,317,957 | 6/1994 | Gaudio | 36/50.1 |
| 5,319,868 | 6/1994 | Hallenbeck | 36/54 |
| 5,463,822 | 11/1995 | Miller | 36/50.1 |
| 5,467,537 | 11/1995 | Aveni et al. | 36/50.1 |
| 5,659,982 | 8/1997 | Muraoka et al. | 36/50.1 |

FOREIGN PATENT DOCUMENTS

| | | |
|---|---|---|
| 27 52 301 | 5/1979 | Germany . |
| 83 15 861 | 11/1983 | Germany . |
| 32 19 652 | 12/1983 | Germany . |
| 39 25 656 | 2/1991 | Germany . |
| 40 28 157 | 9/1991 | Germany . |

*Primary Examiner*—M. D. Patterson

*Attorney, Agent, or Firm*—Nixon Peabody LLP; David S. Safran

[57] ABSTRACT

A sports shoe, in particular a soccer shoe, with an upper (1) comprising an instep region (8), with a sole (2) connected to the upper and with tension strips (3, 4, 5) for stiffening. The sole is stiffened by a front tension strip (3) connecting the front end (6) of the sole to the upper (1) and by two rear tension strips (4, 5) connecting the heel area (7) of the sole (2) to the upper (1) in such a manner that although it is still possible to bend the sole up completely, it is impossible to bend it down.

15 Claims, 1 Drawing Sheet

ATHLETIC SHOE, ESPECIALLY SOCCER SHOE

BACKGROUND OF THE INVENTION

1. Field of the Invention

The invention relates to an athletic shoe, especially a soccer shoe with a upper which surrounds the instep area, a sole joined to the upper, and tension bands for stiffening.

2. Description of Related Art

This athletic shoe is known for example from DE 27 52 301 A1. The tension bands described there are designed to ensure more direct transfer of force between the foot and the shoe sole and thus to reduce fatigue phenomena on the upper itself. Moreover the traction of the foot in the shoe will be improved by the aforementioned tension bands.

One problem in athletic shoes, especially soccer shoes, is that the sole must have high flexibility to prevent hindering the natural rolling process of the foot when running. The energies which must be expended during running to deform the sole can be minimized when a sole as flexible as possible is used, On the other hand, an overly light and flexible sole often entails an major injury risk. Bending of the sole against its natural arch downward can occur for example when running when the foot is placed on an uneven surface, for example, a stone.

In soccer shoes it is especially disadvantageous if the sole is allowed to bend downward. Soccer shoes must be light and very flexible. They should have especially thin soles which do not hinder the rolling motion of the foot when running. The upper should also consist of very thin soft leather which conforms closely to the foot to ensure better feeling of the ball.

When taking a shot, especially with the instep, in which the ball is hit with the extended foot, it holds that bending of the sole downward should be prevented as much as possible and the foot should accordingly be supported inflexibly. This is because the impact force and ball speed are reduced when the sole and accordingly the foot yield downward, by which a large amount of the impact force is lost. Satisfactory transfer of momentum cannot be achieved with a sole which yields downward.

To solve this problem in a soccer shoe it is proposed in published German Patent Application DE 32 19 652 A1 that on the bottom of a sole formed from inherently soft base material there be material parts with greater hardness which are provided with stops and counterstops. Bending of the sole downward is prevented by the stops and counterstops of the material parts located on the bottom of the sole coming into contact. This known design results in a relatively complex sole structure. In addition it no longer takes effect to the desired degree in heavy, muddy ground. The gap between the stop and counterstop fills with soil or the like so that the sole arches accordingly upward with increasing duration of play. The interplay of the stop and counterstop is lost.

SUMMARY OF THE INVENTION

The object of the invention is to devise an athletic shoe, especially a soccer shoe, in which bending of the sole downward is for the most part prevented, but without limiting the flexibility of the sole necessary for the rolling process, regardless of the subsoil on which the shoe is being used.

This object is achieved by an athletic shoe in accordance with the present invention as described below.

The key idea of the invention is to provide tension bands which extend from the front and back end of the sole running obliquely upwards towards one another towards the instep area of the upper and which are connected especially there to one another into a support structure.

This arrangement of tension bands stiffens the sole as easily as possible against bending downward. The stiffening action is increased by the foot itself which is in the shoe, since the front and the two back tension bands are supported at their connection point on the instep of the foot. This effectively counteracts the deflection of the sole downward and the corresponding deformation of the upper.

Preferably the front and the two back tension bands are tensioned against one another by lacing located especially in the instep area of the upper or by a tensioning cable closure. When the laces are undone or the tensioning cable closure is opened it is easy to put the shoe on or take it off. The lacing or tensioning cable closure allows the tension bands to be prestressed such that the sole undergoes the desired stiffening effect. By means of the variable adjustment possibilities of the lacing or tensioning cable closure not only is matching to different foot shapes possible, but the desired prestress of the tension bands can also be adjusted. This applies especially when separate tension means are assigned to the tension bands in the instep area, i.e. tension means which are independent of conventional lacing, etc.

Furthermore, it is advantageous if there is a support element which runs essentially transversely to the longitudinal extension of the shoe and which engages both its ends in the middle area of the sole and extends over the instep area of the upper.

This support element causes further stiffening of the sole. It complements and expands the above described support by the front and back tension bands. The overall arrangement of front and back tension bands, the support element and sole yields a self-supporting support structure which prevents bending downward, without adversely affect flexibility upward. The foot itself is no longer necessary for stiffening. In this way the mobility of the foot is promoted in the normal rolling process. The foot can be held in the shoe under less stress. This applies especially when the support element is joined to the front and two back tension bands in the instep area in the manner of a knot. The upper then has essentially only the function of "clothing" the foot.

Preferably the tension bands consist of aramid fibers, especially Kevlar or carbon fibers. These fibers have extremely limited extensibility and at the same time have extremely high tensile strength.

The support element can be produced from relatively stiff PE, PA or similar plastic strip. In an especially soft embodiment the support element is produced from the same material and in the same way as the tension bands and is attached to the upper or integrated thereon.

When the tension bands are interwoven with leather or similar upper materials, flat strips can be formed which conform especially well to the upper of the shoe.

It is especially advantageous in this case to sew the tension bands onto or into the upper. This eliminates friction sites between the tension bands and the upper. Finally, tension bands sewn on the outside can impart a pleasing appearance to an athletic shoe, especially a soccer shoe.

The invention is detailed below also with respect to other features and advantages using the description of one embodiment and with reference to the attached drawings.

DETAILED DESCRIPTION OF THE PREFERRED EMBODIMENT

Figure 1:
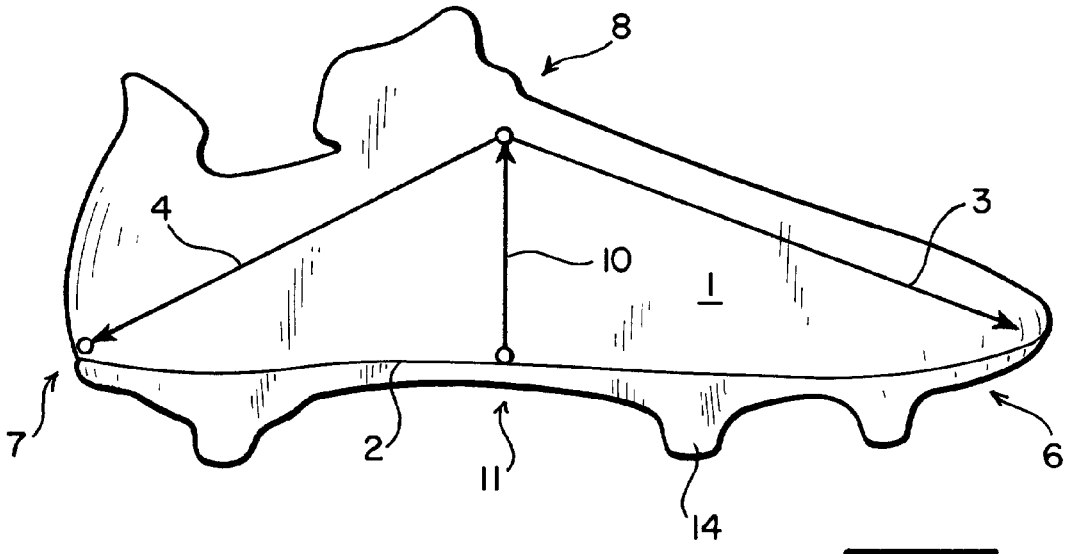
FIG. 1 shows a schematic of an athletic shoe according to one embodiment of the invention.

FIG. 1 shows a sketch of a soccer shoe. The soccer shoe consists of upper 1 and sole 2. Upper 1 and sole 2 are joined to one another using one of the conventional techniques, for example, sewn and/or bonded or cemented. On the bottom of sole 2 there are conventionally nubs 14 which are used for better traction on soft ground such as turf, etc. From front sole end 6 there extends front tension band 3 running obliquely upward to instep region 8 of upper 1. Two back tension bands 4 and 5 extend from heel area 7 of the sole into instep area 8 and are joined there to front tension band 3 directly or indirectly, for example via eyelet strip 13 (see FIG. 2). Back tension band 4 runs on one side of upper 1 from the instep to the ankle. On the opposite side of the upper other tension band 5 is positioned accordingly (compare FIG. 3).

To increase the stiffness and make available a self-supporting arrangement, there can furthermore be band-like support element 10 which runs essentially transversely to the longitudinal extension of the shoe and engages its two ends in middle area 11 of sole 2. In doing so it extends over instep area 8 of upper 1 so that the arc formed by support element 10 does not hinder the foot held in the shoe.

The arrangement of tension bands and the support element shown in FIG. 1 effectively prevents bending of sole 2 downward. This applies especially when the shoe is put on, since then additional support of the tensions bands on the instep takes place, in the embodiment shown via eyelet strip 13. The force exerted in a soccer shoe in an instep shot on forward area 6 of sole 2 is absorbed via front tension band 3 by rear tension bands 4, 5 and support element 10. In this way bending of the sole downward is for the most part prevented. The foot is supported accordingly. In a hiking shoe with a support structure of the described type, pressing of middle area 11 of sole 2 inward for example when stepping on a rock, root or similar barrier is prevented by support element 10 being supported against tensioned front 3 and back tension bands 4, 5. The described shoe structure is of course also suited for track and field, bicycling, basketball or similar athletic shoes.

Preferably the front and the two back tension bands are tensioned against one another by lacing located especially in the instep area of the upper or by a tensioning cable closure. When the laces are undone or the tensioning cable closure is opened it is easy to put the shoe on or take it off. The lacing or tensioning cable closure allows the tension bands to be prestressed such that the sole undergoes the desired stiffening effect. By means of the variable adjustment possibilities of the lacing or tensioning cable closure not only is matching to different foot shapes possible, but the desired prestress of the tension bands can also be adjusted. This applies especially when separate tension means are assigned to the tension bands in the instep area, i.e. tension means which are independent of conventional lacing, etc. It is noted that tensioning cable closures for athletic shoes are well known and relative to which reference can be made to U.S. Pat. Nos. 5,181,331; 5,197,882; 5,319,868; 5,325,615; 5,327,662; 5,341,583; 5,355,596; 5,381,609; 5,502,902; 5,600,874; and 5,737,854, for examples thereof.

Figure 2:
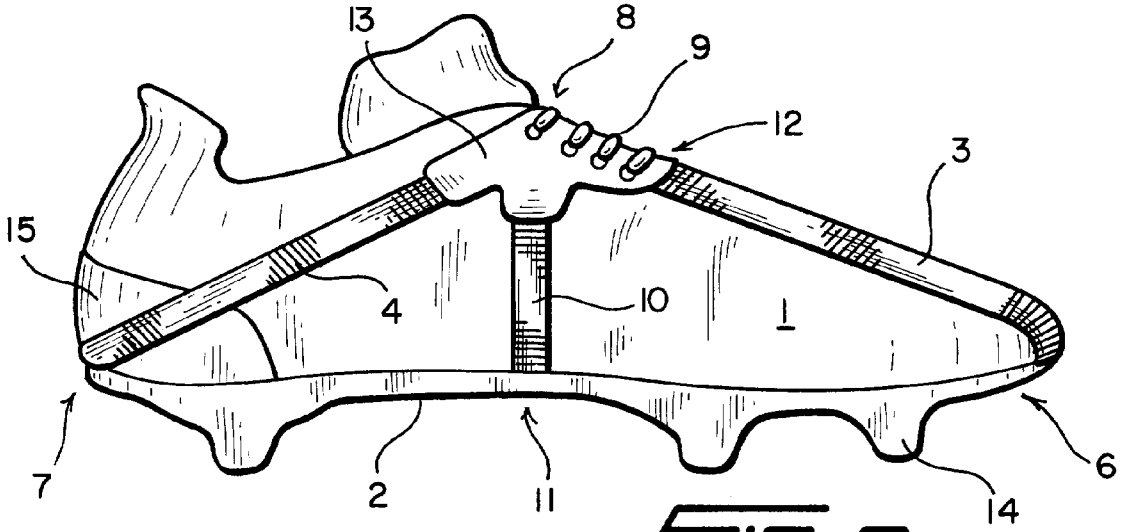
FIG. 2 shows a side view of an athletic shoe according to the schematic as shown in FIG. 1.

FIG. 2 shows a soccer shoe as shown in the sketch in FIG. 1 in a side view. Front tension band 3 and rear tension bands 4, 5 consist of aramid fibers, especially Kevlar or carbon fibers. In this way the tension bands have high tensile strength and in addition stretch very little. The strip-shaped configuration of the tension bands shown in FIG. 2 is formed by their being interwoven with leather or similar upper material. Furthermore, tension bands 3, 4, 5 are sewn onto upper 1; this imparts a pleasing appearance to the shoe overall.

Tension bands 3, 4, 5 in the embodiment as shown in FIG. 2 are not connected directly to one another, but via two eyelet strips 13. Eyelet strips 13 are reinforced relative to the upper material such that they have high tensile strength and at the same time stretch very little. Two eyelet strips 13 border lace slot 12 formed in instep area 8 of upper 1.

Front tension band 3 is attached to two eyelet strips 13 on their front, lower end. Two eyelet strips 13 could be equally well connected forward to one another and the front tension band could be attached in the area of this connection. Two rear tension bands 4, 5 are likewise attached to two eyelet strips 13.

Support element 10 can run either without direct attachment to eyelet strips 13 under them and extend continuously over the instep area of upper 1; alternatively support element 10 is divided into a first and a second section. The first and second section then extend from middle area 11 of sole 2 to eyelet strip 13 assigned at the time and are attached thereto.

Attachment of tension bands 3, 4, 5 and the described support element sections to eyelet strips 13 can be done using conventional technology, for example by cementing, sewing, riveting, bonding, etc. The same applies to the connection to sole 2.

Figure 3:
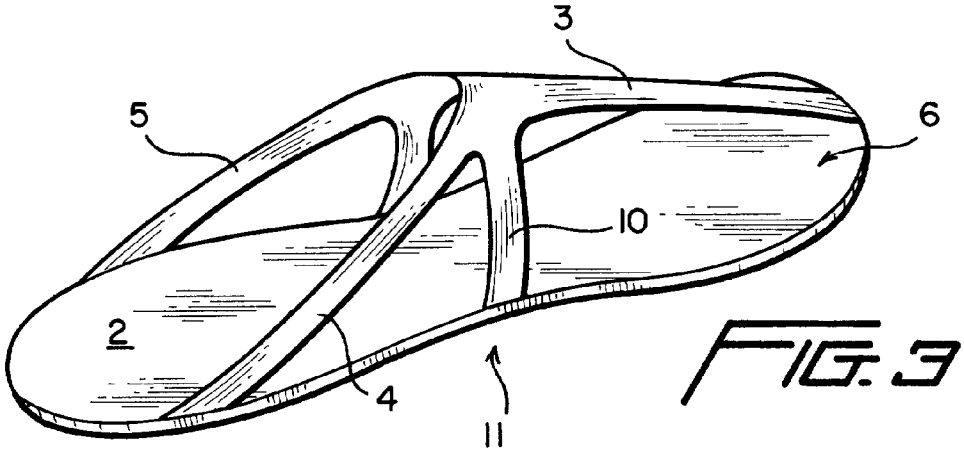
FIG. 3 shows a three-dimensional sketch of the arrangement of the tension bands and the support element according to the embodiment shown in FIG. 2.

The sketch as in FIG. 3 schematically shows the basic structure consisting of tension bands 3, 4, 5 and support element 10 for stiffening of sole 2 downward. Of course the figure is purely schematic, since to fit the foot there is the knot on which the tension bands and support element run together divided lengthwise with formation of a lace slot. Thus the instep opening of the shoe defined on the one hand by support element 10 and by sole 2 on the other can be changed and matched individually to the foot of the user. In this way the support of sole 2 can also be adjusted upward.

Of course, within the framework of the invention there can be other tension bands and support elements or their arrangement can be modified. The described basic structure should however be preserved in all cases. For example, an arrangement of two front tension bands which run in a roughly V-shape to the front or parallel to one another is conceivable.

Likewise it is possible to replace one or more tension bands 3, 4, 5 entirely or partially by relatively low-stretch materials or upper sections which have the same action, which absorb tension, and which are preferably an integral part of upper 1. In the shoe shown in FIG. 2, over ankle region 7 of sole 2 ankle upper cap 15 is formed which is connected to ankle region 7 of sole 2. Tension bands 4, 5 can be attached equally well to ankle upper cap 15 instead of to sole 2 when ankle shank cap 15 is made appropriately strong or stiff.

Accordingly a toe cap can also be formed to which the front end of the front tension band is then attached.

What is claimed is:

1. Athletic shoe comprising:

an upper having a portion which surrounds an instep area of a wearer's foot;

a sole joined to the upper; and tension bands for stiffening the sole;

wherein said tension bands include at least one front tension band which connects a front end of the toe portion of the sole to the upper and which extends obliquely upward and rearward from the front end of the sole into the instep area portion, and at least two rear tension bands which connect a heel area of the sole to the upper and which extend obliquely upward and forward from the heel area of the sole into the instep area portion; and wherein said tension bands engage the upper at the instep area portion.

2. Athletic shoe according to claim 1, wherein the tension bands are joined to one another.

3. Athletic shoe according to claim 2, wherein said shoe is a soccer shoe having a sole with projecting cleats.

4. Athletic shoe as claimed in claim 1, further comprising a slot and tightening means for drawing opposite sides of said slot toward each other; wherein said slot and tightening means are arranged relative to said tension bands in a manner applying tension between the tension bands when said opposite sides of the slot are drawn together.

5. Athletic shoe as claimed in claim 4, wherein the slot and tensioning means for the tensioning bands is separate from lacing for the shoe upper.

6. Athletic shoe as claimed in claim 4, wherein said slot and tensioning means are located in said instep area portion of the upper.

7. Athletic shoe as claimed in claim 6, wherein said tightening means comprises shoe laces.

8. Athletic shoe as claimed in claim 1, wherein a support element is provided at each side of the upper which runs essentially transversely to a longitudinal direction of the shoe, which engages a middle area of the sole at one end thereof, and which extends over said instep area portion of the upper.

9. Athletic shoe as claimed in claim 8, wherein the support elements are connected to the tension bands.

10. Athletic shoe as claimed in claim 9, wherein said portion of the upper has a lace slot which is bordered by two reinforced eyelet strips; and wherein the eyelet strips are joined to the tension bands.

11. Athletic shoe as claimed claim 10, wherein the eyelet strips are joined on both sides of the upper to the support elements.

12. Athletic shoe as claimed in claim 1, wherein said instep area portion of the upper has a lace slot which is bordered by two reinforced eyelet strips; and wherein the eyelet strips are joined to the tension bands.

13. Athletic shoe as claimed in claim 1, wherein the tension bands are made of a material selected from the group consisting of aramid fibers, or carbon fibers.

14. Athletic shoe as claimed in claim 13, wherein the tension bands are sewn to the upper.

15. Athletic shoe as claimed in claim 1, wherein the tension bands are sewn to the upper.

* * * * *